United States Patent [19]

Bachmann

[11] 4,432,179

[45] Feb. 21, 1984

[54] LOW HEAT TRANSMISSION FRAMING RAIL STRUCTURE, PARTICULARLY DOOR OR WINDOW FRAMING

[76] Inventor: Otto Bachmann, Birkenweg 2, CH-6280 Hochdorf, Switzerland

[21] Appl. No.: 321,404

[22] Filed: Nov. 16, 1981

[30] Foreign Application Priority Data

Dec. 8, 1980 [CH] Switzerland ..... 9036/80

[51] Int. Cl.[3] ..... E04B 1/62

[52] U.S. Cl. ..... 52/396; 49/DIG. 1; 49/DIG. 2; 52/732

[58] Field of Search ..... 52/396–403, 52/730, 732; 49/404, 504, DIG. 1, DIG. 2

[56] References Cited

U.S. PATENT DOCUMENTS 3,462,884 8/1969 Bissoniere ..... 49/404
4,118,266 10/1978 Kerr ..... 49/DIG. 1

FOREIGN PATENT DOCUMENTS 200312 4/1958 Austria .
2915255 10/1979 Fed. Rep. of Germany ..... 52/730
768499 2/1957 United Kingdom ..... 49/504

*Primary Examiner*—James L. Ridgill, Jr.
*Attorney, Agent, or Firm*—Frishauf, Holtz, Goodman & Woodward

[57] ABSTRACT

To reduce heat transmission between an inside area (J) and an outside area (A) in an aluminum casement window or door frame construction, the frame is formed of three seperate rail elements (6, 7, 8) which are structurally interconnected by glass fiber reinforced polyester strips (9, 10) which are positioned to cooperate with steps (20*a*, 20*b*, 20*c*) formed on a wood window or door frame so that, upon closing the window or door, two air chambers (12, 14) will be formed, separated by an intermediate projecting strip (37) projecting from the intermediate rail (7); additional sealing strips (16) can be provided, the strips being retained between legs (22, 26) formed on the rails and defining grooves therebetween.

15 Claims, 1 Drawing Figure

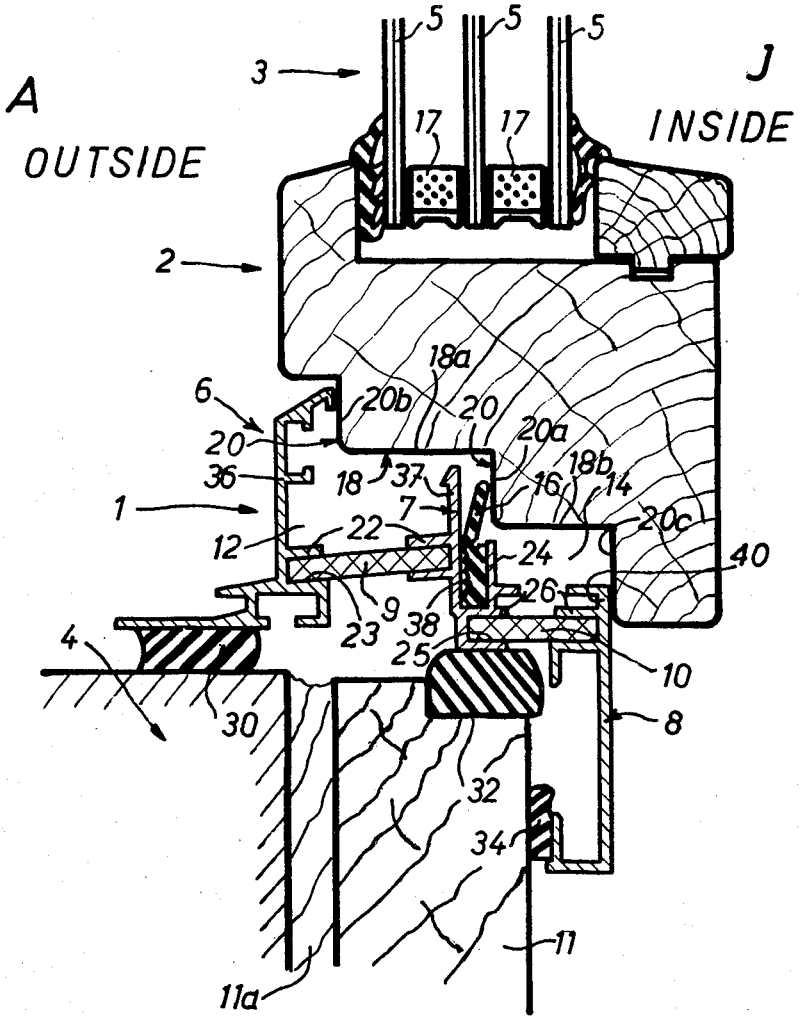
A
OUTSIDE
J
INSIDE
3
5
5
5
17
17
2
6
20
36
1
12
4
30
11a
18a
20b
20
20a
18
37
7
22
16
18b
14
20c
24
40
9
23
38
26
25
10
8
32
34
11

LOW HEAT TRANSMISSION FRAMING RAIL STRUCTURE, PARTICULARLY DOOR OR WINDOW FRAMING

The present invention relates to aluminum rail structures particularly useful in making door or window frames which have low heat transmission between a framing element adapted to be exposed to ambient temperatures, and another rail element adapted to be exposed to a heated atmosphere within a building, and further to a framing construction for windows, doors, or the like, using the rails.

BACKGROUND

Various types of metal frames for windows and doors are known which are insulated with respect to heat transfer through the metal. They utilize two rail elements, with a heat transmission blocking material therebetween. Such heat transfer blocking materials may, for example, include strips, rods, or the like, made of plastic, hard rubber, or similar materials. (See Austrian Patent No. 200,312, to which British No. 768,499 corresponds).

The selection of materials for heat blocking and structural use is limited; likewise, the dimensions of a heat transfer blocking material cannot be selected as may be desired for most efficient blocking of heat transmission due to difficulties in manufacture, shaping of the materials, and differences in expansion characteristics of the materials under varying temperatures. Thus, interruption of heat transmission from an element exposed to outside ambient temperature to an element exposed to an inside ambient temperature is obtainable only to a limited degree. If the temperature difference between outside and within an enclosed space, hereinafter referred to as "inside", is substantial, condensation may additionally occur, which further causes difficulty. Transmission of heat through glass areas can be substantially decreased by using multiple glazing, for example by using triple-glazing; unless the framing structure for such triple-glazed windows is, however, also of low heat transmissivity, the overall effect achieved is not satisfactory.

THE INVENTION

It is an object to provide a rail structure which can be made of a material having high heat transmissivity—typically aluminum—which is so arranged that the transmissivity of heat from an outside rail to an inside rail is low, so that the advantages obtained by, for example, triple-glazing of a window or door, are also obtained by the framing structure with which the window or door cooperates.

Briefly, three separate elongated rails are provided oriented in parallel to each other, made for example of aluminum or similar structural metal. A first strip of heat insulating material, for example plastic or the like, preferably fiberglass-reinforced plastic, is secured to the first rail at one side and to a second or intermediate rail at the other; the second, intermediate rail, at the side opposed to the first plastic strip, secures a second connecting strip which, in turn, is attached to the third rail. The plastic strips, themselves, thus can be comparatively short, so that the overall structural rigidity of the assembly formed by the three metal rails and the two interposed rail-plastic strips is insured. In addition to the heat-insulated connection between the three rails, at least two of them are formed with extended projections which are so shaped that they form, with a window or door counter element, two air chambers defined by the projecting rail strips and the connecting insulating strips, and matching surfaces of a window framing. The window framing may, for example, be of wood, but may also be of metal, and need be shaped only such that the chambers defined by the projections of the rail strips which preferably terminate at staggered ends are closed, and to prevent entry of rain or drafts.

To further improve the heat blocking effect, engaging surfaces between the window or door framing and the projecting strips may have interposed plastic sealing strips which can be elastically compressed.

The structure has the unexpected advantage that merely by interposing air chambers and two short insulating material connecting strips—rather than using one longer one—a substantially better heat blocking effect can be obtained than with a structure of similar dimensions having only a single low heat transmitting strip between outer and inner aluminum rails, even if the prior art heat transmission blocking strip has approximately the same cross-sectional area or lateral extent as the two heat blocking strips connected in accordance with the present invention. The two chambers, which are serially located with respect to heat transmission, effectively prevent heat transfer by convection; the temperature gradient is distributed in two steps or stages. This arrangement permits the use of rails made of aluminum, with the attendant advantages of resistance against corrosion and weathering, stability of shape, freedom from maintenance and painting, and essentially trouble-free unattended use for a long period of time while, additionally, inhibiting heat loss.

DRAWING

The single FIGURE shows a vertical cross section through a casement-type window closure utilizing the low heat loss structure of the present invention.

The structure illustrates a fragment of a window to separate an outside area A from an inside area J. The structure includes a fixed metal frame 1 which, when used in a door, may be a metal door buck; it cooperates with a casement-type frame 2 of a window. The frame is made of wood, and retains triple insulating glazing 3 constructed of three glass panes 5 retained spaced from each other by sealing strips 17. The glass panes 5 are secured in the frame 2 in a suitable and well known manner, for example by wood strips, and additional sealing strips or sealing elements, such as glass putty, and the like.

The frame 1 is secured in customary and suitable manner to a wall 4, which may include an inner wooden frame element 11, separated from the wall 4, for example, by an insulating and moisture barrier panel 11*a*. Of course, the construction of the present invention is equally applicable to an all-wood construction or all-masonry construction. The metal frame 1 is secured to the wall 4, 11 by any suitable manner, for example by nails, screws, and the like, and sealed with respect to the wall 4, 11 by sealing strips 30, 32, 34 made, for example, of rubber or a suitable plastic.

In accordance with the present invention, the aluminum frame 1 is made of three shaped rails; a first, outer rail 6, a second, intermediate rail 7, and a third, inner rail 8. The three rails 6, 7, 8 are connected together by low heat transmitting strips 9, 10. A first strip 9 of approximately rectangular cross section rigidly connects the first rail 6 with the second or intermediate rail 7. The heat insulating strip 9 is fitted into grooves 23 formed by U-shaped projections 22, projecting towards each other from the respective first and second rails 6, 7. The low-heat loss strip 9 is retained in the groove 23 formed by the projections 22 by clamping and/or adhesion. In one form, the strip is inserted in the rail and, before assembly, pinched or compressed along the length, or at suitable intervals.

The second low-heat loss connecting strip 10 has also approximately rectangular cross section, and is retained in grooves 25 formed by U-shaped projecting legs 26 on the second and third rails 7, 8, respectively—see the drawing. The second strip 10 can be secured in the grooves 25 similarly to strip 9, i.e. by clamping and/or adhesion. The strips 9, 10 extend over all four sides of the frame structure 1. With respect to heat transmission, strips 9, 10 are serially arranged. The strip 10, adjacent the inside J, preferably has the same thickness as the strip 9; it is slightly narrower, however; a suitable cross-sectional area for the strip 9 is in the order of between 100–125 $mm^2$; a suitable cross-sectional area for strip 10 is between about 80–100 $mm^2$. Preferably, both of the strips 9, 10 are made of stiff, glass-reinforced polyester plastic. The strip 10 is positioned in the grooves to extend at a right angle to the surface of the window panes 5; the strip 9 is slightly outwardly inclined, so that an angle of, preferably, between about 3° to 10°, most desirably 6°, is formed between the two strips 9, 10. The legs 22, 26, projecting from the respective strips 6, 7, 8 are, preferably, offset with respect to each other in relation to the strips, as is clearly apparent in the FIGURE, so that they are out-of-alignment with respect to a straight path of heat transfer.

The casement frame 2 of the window preferably is made of wood, but may be made of other materials, including metal strips. The casement is so shaped that it has several steps—looked at in horizontal cross section—and, with reference to the FIGURE, a horizontal step portion 18 and a vertical step portion 20. When the frame 2 is closed, two chambers 12, 14 are formed, separated from each other. The chambers are separated by a sealing strip 16 which is elastic and which can engage the center vertical step **20*a* of the window frame 2**.

Operation, and use: When the window frame 2 is closed—see the FIGURE—the first chamber 12 is formed by a projecting rail strip portion 36, extending from rail 6 and uniform therewith, the step **20*b* and step 18*a* of the window frame, a projecting strip 37, and the sealing strip 16 thereon, and the first heat blocking strip 9. The projecting strip 36 of the rail 6 extends approximately parallel to the plane of the glass panes when the window is closed. The second chamber 14 is defined by the sealing strip 16, extending parallel to the strip projections 37 from the central or intermediate rail 7, the vertical wall of the center step on the window frame, horizontal step 18*b* of the window frame, vertical step 20*c*, the inner rail portion 8, and the heat blocking strip 10. As can be seen, the ends of the strips or strip portions are stepped or staggered to permit swinging or pivoting movement of a door or casement-type window, while forming respective side walls of the air chambers 12, 14**.

The intermediate rail 7 has a groove 38, extending upwardly, to receive the sealing strip 16. The extending or projecting strip 37 from the intermediate rail 7 extends above and beyond the U-shaped legs 22 of the first heat blocking strip 9 and terminates just short of the horizontal step portion **18*a* of the frame 2. The vertical portion 20*a* of the frame 2, adjacent the inside or room side J, fits against the inner rail 8. The inner rail 8 projects downwardly, the lower end facing the wood frame 11. The steps 18, 20 of the frame 2 are matched to the length of the projections 36, 37, 40 on the rails 6, 7, 8**.

Various changes and modifications may be made; for example, a sealing strip can be placed in the upper end portion of the projection 36 from rail 6 to fit against the step **20*b* of the frame of the window; an additional elastic sealing strip can also be placed in parallel with the projection 40 on rail 8, fitting against the vertical wall 20*c*. The rails are shown to be formed with additional grooves and holding projections to retain sealing strips, for example made of rubber or foam material, which can be fitted within the grooves, as shown; the projection 40 on rail 8 also may have an upwardly extending groove formed therein, similar to groove 38 on the intermediate strip 7**.

Temperature differences, in the direction of heat transfer between the inside J and the outside A, blocked by a window or door, thus are separated into two discrete steps; an overall heat blocking value K of approximately 1.8 $kcal/m^2$ h C° can be obtained; this is comparable to heat transmission or, rather, heat blocking obtainable by commercial triple-glazed windows.

The rail structure is particularly suitable for replacement railing in existing windows; the window frame 2, as shown, is of standard profile, and the frame and rail structure can be used therewith.

Frame 1 can be used not only for windows and doors, but also to fit sheet-wall panels in place, for example in building construction where rail-like units are used retaining sheathing panels and the like.

For purposes of illustration, the window frame 2 has been shown to be of wood; other materials, of course, can be used, and a structure similar to structure 1 can be employed, with window panes 5 and intermediate strips set in place in approximate alignment with the strip 9. If the strip 9 is not of sufficient strength, tension bolts can be connected, from time to time, along the length of the structure, between the strips 6 and 7, these tension bolts hardly interfering with efficient heat insulation, particularly if additionally insulated from contact with the surrounding aluminium by plastic bushings or washers. For weather tightness, a plastic strip can surround the entire structure, adhesively secured, for example, by a projecting lip, or a tongue-and-groove, snap-in connection.

I claim:

1. Low heat transmission framing rail combination structure, particularly to form aluminum window or door framing elements, for cooperation with a window or door counter element (2)

comprising, in accordance with the invention, three separate elongated, parallel-oriented metal rails (6, 7, 8) forming a first, outer metal rail (6), a second intermediate metal rail (7), and a third, inner rail (8);

a first insulating material connecting strip (9) secured to the outer rail (6) and to the side of the second, intermediate rail (7) facing the outer rail, and structurally connecting said first, outer and second, intermediate rails together and forming an assembly;

a second insulating material connecting strip (10) secured to the other side of the second, intermediate rail (7) and to the facing side of the third, inner rail (8), and structurally connecting said assembly of the first (6) and the second (7) rails and the first strip (9) to the third rail (8), the connecting strips (9, 10) extending outwardly from opposite sides of said second, intermediate strip (7), offset with respect to each other along the width of the rail so as to be out-of-alignment with respect to each other to prevent direct heat transmission between said strips through the intermediate rail (7) and forming continuous structural connection strips between said intermediate metal rail (7) and the first, outer metal rail and the third, inner metal rail (8), respectively, while inhibiting metal-to-metal heat transfer between said rails, and projecting rail strips (36, 37, 40) extending from said separate rails (6, 7, 8) to form, with the window or door counter element, two air chambers (12, 14) separated from each other by the projecting rail strip (37) from the intermediate or second rail (7) and by said two connecting insulating strips (9, 10).

2. Structure according to claim 1, wherein said rails (6, 7, 8) are formed with grooves (23, 25) facing grooves of the adjacent, facing rail, said insulating material strips (9, 10) being securely fitted into said grooves.

3. Structure according to claim 1, wherein at least one of said rails (7) is formed with a groove (24) having an opening facing the rail along the width thereof;

and a sealing strip (16) secured in said opening and positioned in parallel to said projecting rail strip (37) extending from the respective rail (7), said sealing strip being located to be engageable by the window or door counter element (2) for sealing contact therewith, and to separate the window or door counter element (2) from direct engagement with the respective rail (6, 7, 8).

4. In combination with the framing rail structure of claim 1, a window or door frame construction having a door or window frame (2), said door or window frame (2) being formed with three shoulders (20) fitting against the ends of the rail strips (36, 37, 40) and having wall portions (18*a*, 18*b*) intermediate said shoulders defining, with said rail structure, two chambers (12, 14) closed off from access to surrounding air, said chambers being serially positioned with respect to heat transmission and, in the direction of heat transmission, being defined by said strips of insulating material (9, 10) and the wall portions (18*a*, 18*b*) of the door or window frame intermediate said shoulders (20).

5. Construction according to claim 4, wherein said window or door frame (2) comprises a low-heat transmissivity structure to enclose said chambers, in the direction of heat transmission, by heat insulating or low-heat transmissivity walls.

6. Construction according to claim 4, further including at least one sealing strip (16) secured to at least one (7) of the rails, and positioned for engagement with a shoulder (20*a*) formed in said window or door frame to separate said shoulder on the window or door frame from direct contact with said rail, and provide for sealing engagement of the window or door frame with the sealing strip.

7. Construction according to claim 4, wherein the connecting strips (9, 10) are made of fiber reinforced polyester plastic to form a sturdy structural connection between the rails (6, 7; 7, 8)while insulating said rails with respect to heat transmission.

8. Construction according to claim 7, wherein said rails are made of aluminum, and formed with projecting pairs of legs to define, therebetween, grooves, said connecting strips being retained between said legs in said grooves.

9. Structure according to claim 7, wherein the connecting strips (9, 10) are made of fiber reinforced polyester plastic to form a sturdy structural connection between the rails (6, 7; 7, 8) while insulating said rails with respect to heat transmission.

10. Construction according to claim 4, wherein said projecting rails strips (36, 37, 40) have end portions terminating at the side facing the counter element at different stepped or staggered positions;

and wherein the shoulders (20, 20*b*, 20*c*) on the window or door frame are stepped or staggered to fit against the stepped or staggered end portions of the projecting rail strips (36, 37, 40) and define, with said rail strips and said insulating material connecting strips (9, 10) said two serially positioned chambers (12, 14).

11. Construction according to claim 10, wherein said projecting rail strips (36, 37, 40) have end portions terminating at the side facing the counter element at different stepped or staggered positions.

12. Construction according to claim 11, wherein the connecting strips (9, 10) are made of fiber reinforced polyester plastic to form a sturdy structural connection between the rails (6, 7; 7, 8) while insulating said rails with respect to heat transmission.

13. Structure according to claim 1, wherein said projecting rail strips (36, 37, 40) have end portions terminating at the side facing the counter element at different stepped or staggered positions.

14. Structure according to claim 13, wherein said projecting rail strips (36, 37, 40) are unitary with said elongated parallel-oriented metal rails (6, 7, 8).

15. Structure according to claim 14, wherein the connecting strips (9, 10) are made of fiber reinforced polyester plastic to form a sturdy structural connection between the rails (6, 7; 7, 8) while insulating said rails with respect to heat transmission.

* * * * *